United States Patent [19]

Nagano et al.

[11] 4,433,724

[45] Feb. 28, 1984

[54] ELECTRODE DEVICE FOR ELECTRICALLY HEATING UNDERGROUND DEPOSITS OF HYDROCARBONS

[75] Inventors: Toshio Nagano, Osaka; Toshiyuki Kobayashi, Hyogo; Nobutaka Koshirakawa, Hyogo; Takeo Inoue, Hyogo, all of Japan

[73] Assignee: Mitsubishi Denki Kabushiki Kaisha, Tokyo, Japan

[21] Appl. No.: 250,379

[22] Filed: Apr. 2, 1981

[30] Foreign Application Priority Data

Apr. 14, 1980 [JP] Japan ..... 55-51127

[51] Int. Cl.[3] ..... E21B 36/04

[52] U.S. Cl. ..... 166/60; 166/65 R; 174/138 D; 285/DIG. 12; 285/259

[58] Field of Search ..... 166/248, 65 R, 60; 174/6, 138 D; 285/53, 259, DIG. 12, 368, 238

[56] References Cited

U.S. PATENT DOCUMENTS 691,346 1/1902 Barr ..... 285/368
2,632,942 3/1953 Berg et al. ..... 285/368 X
3,419,290 12/1968 Campbell et al. ..... 285/DIG. 12 X
3,878,312 4/1975 Bergh et al. ..... 166/248 X
3,977,709 8/1976 Hatzis ..... 285/368
4,218,078 8/1980 Lee ..... 285/DIG. 12 X

*Primary Examiner*—Ernest R. Purser
*Assistant Examiner*—Michael Starinsky
*Attorney, Agent, or Firm*—Sughrue, Mion, Zinn, Macpeak and Seas

[57] ABSTRACT

An electrode device for electrically heating underground deposits of hydrocarbons in which an insulated pipe is disposed between an electrode and a main guide pipe. The two end portions of the insulated pipe are formed as flanges having outer circumferential surfaces counter tapered to diverge at a predetermined angle toward the end portions. Shock absorbers are disposed between fastening fixtures and the counter-tapered surfaces of the insulated pipe and the fastening fixtures are coupled to connectors on the main guide pipe and the electrode through bolts. If desired, the abutting surfaces of the main guide pipe and the electrode can be formed counter tapered similarly to the counter-tapered surfaces of the insulated pipe.

4 Claims, 4 Drawing Figures

ELECTRODE DEVICE FOR ELECTRICALLY HEATING UNDERGROUND DEPOSITS OF HYDROCARBONS

BACKGROUND OF THE INVENTION

The present invention relates to an electric device used to electrically heat underground deposits of hydrocarbons. More specifically, the present invention relates to an electrode device which is used to supply electrical power to an underground deposit thereby to heat the hydrocarbons present in the deposit to cause them to have a lower viscosity and higher fluidity in order to more easily remove them from the well.

The term "hydrocarbons" as used hereinafter means petroleum or oil, bitumen contained in oil sand (also called "tar sand") and kerogen contained in oil shale. These will all be referred to as "oil" for simplicity.

If the oil in the underground deposit has sufficient fluidity, it is possible to extract the oil through the well either by gas pressure coexisting in the oil layer or by forcing a liquid such as brine into one well to force the oil to flow out of another well. However, should the underground oil have low fluidity, it cannot be extracted until the oil is made more fluid. A general method of making the oil fluid is to heat the oil thereby to lower the viscosity of the oil. The temperature suitable for this is different for different types of oil.

There have been proposed as oil layer heating methods the injection of hot water or water vapors at a high temperature under a high pressure, supplying electrical power to the underground deposit, underground combustion in which the underground oil layer is ignited with a supply of air so that it may be burned, and the use of explosives. The last two methods are difficult to control so that they are not in general use.

According to the method of injecting the hot water or water vapor at a high temperature and under a high pressure, the oil layer is heated to enhance the fluidity of the oil to cause the fluid oil to flow out to the ground surface. If, however, some regions of the oil deposit have a low resistance to the flow of hot water or water vapors or there are voids in the oil layer, the water or vapors may collect in these regions and fail to diffuse throughout the whole layer. Moreover, if the oil layer is solid and dense, the hot water or its vapors will again not diffuse so that the oil layer cannot be heated.

Heating by the supply of electrical power is performed by drilling a plurality of wells in the oil layer and by establishing potential differences between electrodes disposed in the wells so that the oil layer is heated by its resistance to the electrical current which flows therethrough. This technique is advantageous in that the oil layer can be wholly heated with ease even if it has voids or is solid and dense. However, another device is required for pumping up the fluid oil.

For improving the oil producing efficiency, there has further been proposed a method which includes a first step of heating the oil layer by electrical resistance heating and a step of injecting hot water or water vapors at a high temperature and under a high pressure when the oil layer becomes soft while continuing the heating so that the resultant fluid oil may be pumped out. In order to efficiently heat the oil layer, the electrode device must be sufficiently electrically insulated that the leakage of electrical current into underground portions other than the oil layer is avoided as much as possible. The electrode device is also required to be unbreakable with respect to the underground soil pressure, the pressure of the vapors which are generated by the heating operation, and the pressure of injected hot water or hot high pressure water vapors. The electrode device is further required to be free from leakage of hot water or hot high pressure water vapors.

In order to explain the electrode device of this general type more fully, an example in which the oil is extracted from oil sand will be described.

Oil sand, also called "tar sand," is present in large quantities in Canada, Venezuela and the United States. The oil in the oil sand is typically mixed with brine between sands in deposits. Moreover, it typically has such a remarkably high viscosity that it has essentially no fluidity in its natural state. A deposit of the oil sand may be partially exposed in a valley or at the banks of a river but is most often located entirely underground at a depth of 200 to 500 m while having a thickness of several tens of meters. Due to consideration of economy and environmental protection, it is necessary to separate out the oil underground and to extract only the oil from the well. Moreover, since the extraction of oil from a shallow underground layer is accompanied by a danger of subsidence, it is desirable to extract oil only from underground layers lying deeper than 300 m.

FIG. 1 illustrates the heating of an oil sand layer by electrodes coupled to a power supply. In FIG. 1, reference numerals 1 and 11 indicate main guide pipes made of steel, 2 and 12 indicate insulators joined to the main guide pipes 1 and 11, 3 and 13 indicate electrodes joined to the insulators 2 and 12, perforations are formed in the electrodes 3 and 13, and 4 and 14 indicate cables for feeding an electric current to the electrodes 3 and 13. This assembly is hereinafter called together the "electrode device." Reference numeral 5 indicates a power source, 6 indicates an oil sand layer, 7 indicates an electric current flowing between the electrodes 3 and 13, 8 indicates the ground surface, 9 indicates an overburden layer, and 10 indicates a layer below the oil sand layer.

When a voltage is applied on the electrodes 3 and 13 which are buried in the oil sand layer 6 from the power source 5 through the cables 4 and 14, the current 7 flows in accordance with the electric resistance of the oil sand layer 6 as a result of which the oil sand layer 6 is heated by Joule or resistance heating. Although, the current 7 partially flows into the overburden layer 9 and the layer 10, the leakage is maintained at a low level because the insulators 2 and 12 are interposed between the main guide pipes 1 and 11 and the electrodes 3 and 13. After the oil sand layer 6 has been warmed, the power supply is interrupted. Hot water or water vapors at a high temperature under a high pressure are then forced from the upper inlet of one main guide pipe 1 of the electrode device and flow through the oil sand layer 6 until they come out of the other main guide pipe 11 carrying the oil. In order to improve the flow rates of the hot water or the hot pressure water vapors, perforations are formed in the electrodes 3 and 13.

The electrode device is required to have a sufficient strength as to not break when it is buried and to withstand the soil pressure after it has been buried, to be free from deformation or breakage when in the well due to the temperature rise (which is remarkably prominent in the vicinity of the electrodes where the current density is high), to withstand the static pressure of the liquid with which passes therethrough, and to be free from breakage or leakage when hot water or hot high pressure water vapors are injected. If the electrode device is buried underground as deeply as 500 m, a pressure as high as 50 kg/cm$^2$ may be applied if the specific gravity of the filling liquid is 1 (for water) and the temperature of the water vapors may reach as high as 265° C.

FIG. 2 shows a conventional electrode device in which an insulated pipe 2 of porcelain is connected to the main guide pipe 1 and the electrode 3 by connecting fixtures. Reference numerals 1 to 4, 6 and 9 in FIG. 2 indicate elements similar to those of FIG. 1 while reference numerals 15, 16 and 17 indicate components of the connecting fixtures including a connector, fastening fixtures and fastening bolts, respectively. At both ends of the insulated pipe 2 are formed disc-shaped flanges. The main guide pipe 1 and the electrode 3 have end portions formed with disc-shaped flanges designed to mate with those of the insulated pipe 2. In order to connect the insulated pipe 2 to the main guide pipe 1 and the electrode 3, the fastening fixtures are applied to the aforementioned disc-shaped flanges and the fastening bolts 17 are tightened, as shown in FIG. 2, until the insulated pipe 2 is brought into abutment against the end faces of the main guide pipe 1 and the electrode 3.

The operations of heating the oil sand layer 6 thereby to facilitate the pumping of the oil are similar to those described with reference to FIG. 1.

The insulated pipe 2 of the conventional device thus far described is so shaped that, if the insulated pipe 2 is supplied with hot water under pressure, both its ends are pulled with the tensile stress being concentrated in a region A indicated in FIG. 2. As a result, the insulated pipe 2 has a defect that it can be broken even by a relatively low hot water pressure.

It is, therefore, an object of the present invention to provide an electrode device for heating underground deposits of hydrocarbons which includes an insulated pipe which has a sufficient strength and which is constructed such that there is no particularly high concentration of stress.

SUMMARY OF THE INVENTION

In accordance with this and other objects of the invention, there is provided an electrode device for electrically heating underground deposits of hydrocarbons including an insulated pipe having end portions with outer circumferential portions of the end portions formed with counter-tapered surfaces which diverge at a predetermined angle toward the end portions. Fastening fixtures are provided which have surfaces tapered corresponding to the counter-tapered surfaces of the insulated pipe. Shock absorbers are disposed between the fastening fixtures and the counter-tapered surfaces of the insulated pipe. Means such as bolts are provided for coupling the fastening fixtures to connectors which are formed on a main guide pipe and the electrode. Preferably, the predetermined angle is in a range of 20° to 70° with respect to the axial direction of the insulated pipe. Also, the end surfaces of the electrode and main guide pipe may be counter-tapered similarly to the counter-tapered surfaces of the insulated pipe.

DESCRIPTION OF THE PREFERRED EMBODIMENTS

Figure 1:
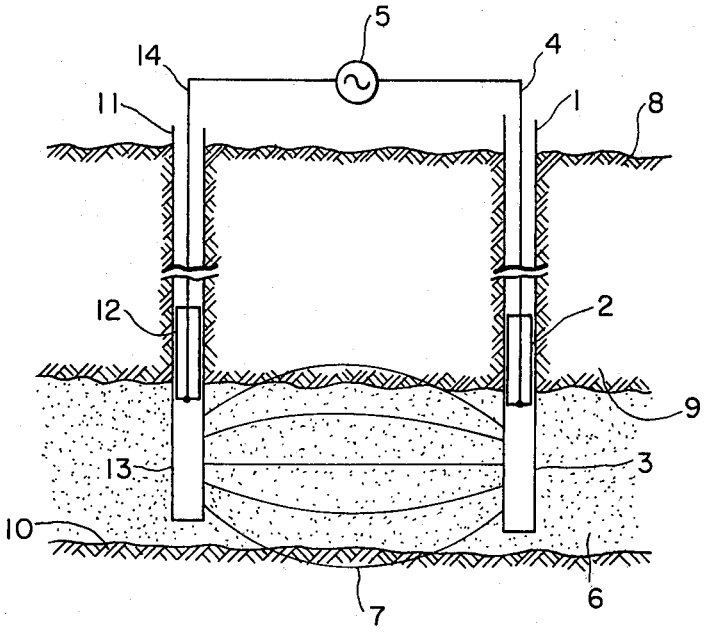
FIG. 1 is a schematic sectional view showing a construction of an oil sand heating system.
Figure 2:
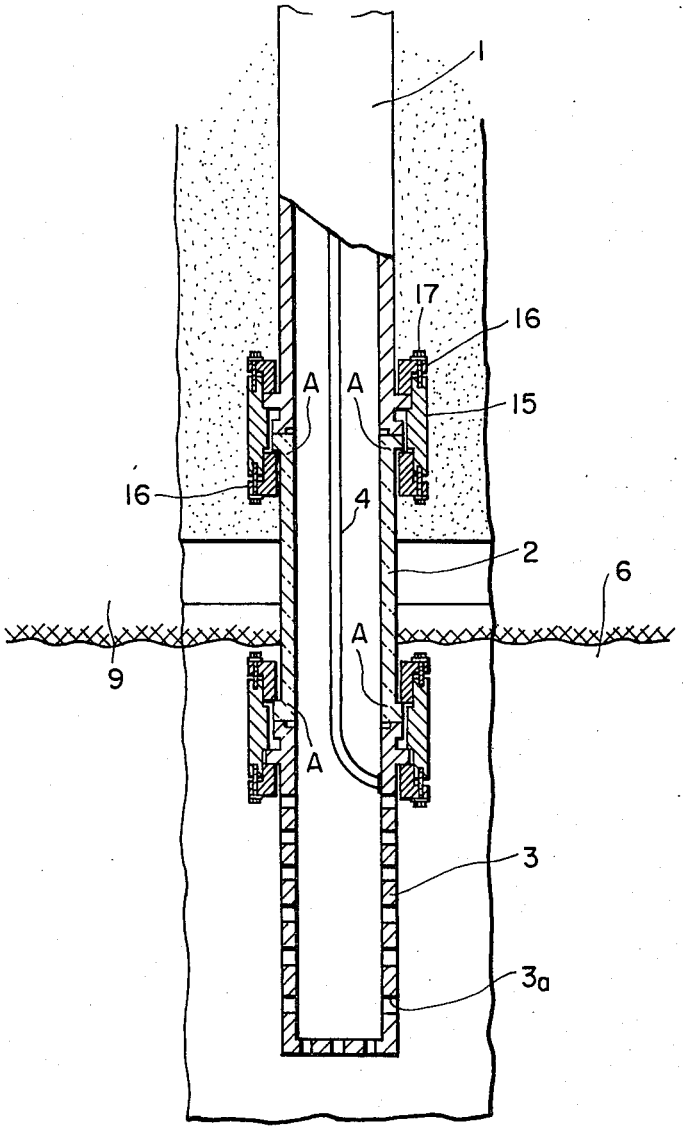
FIG. 2 is a sectional view showing an electrode device according to the prior art.
Figure 3:
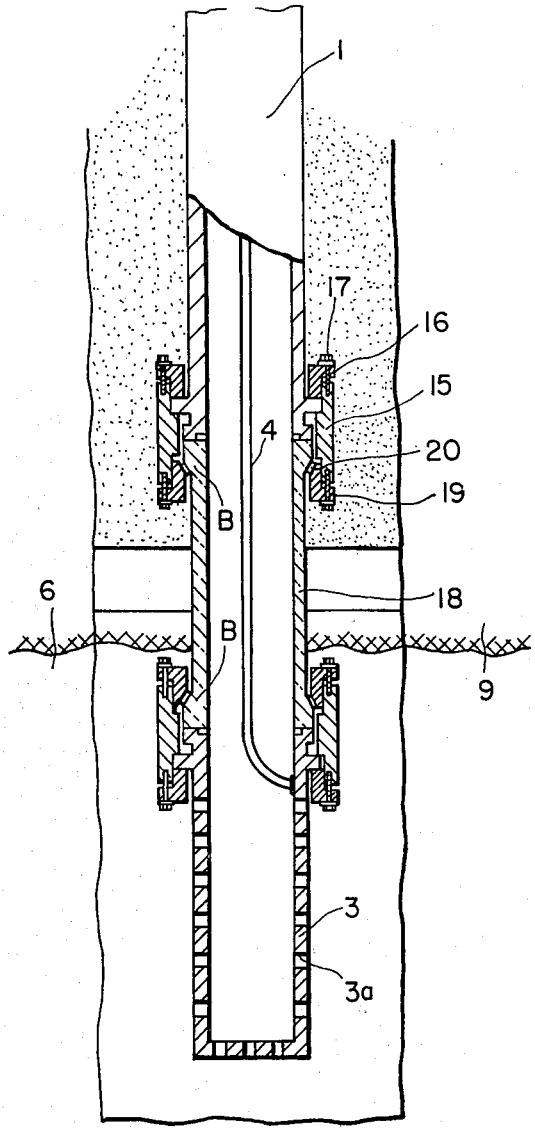
FIG. 3 is a sectional view showing a first embodiment of the present invention.

FIG. 3 is a sectional view showing an electrode device according to a preferred embodiment of the present invention. Reference numerals 1, 3, 4, 6, 9, 15, 16 and 17 indicate elements similar to those of the conventional device of FIG. 2. Also, the fastening system at the sides of the main guide pipe 1 and the electrode 3 of the connectors 15, the fastening fixtures 16 and the fastening bolts 17 is similar to those of the conventional device. Reference numeral 18 indicates an insulated pipe made of porcelain the ends of which are counter-tapered, as shown in FIG. 3, at an angle of 20° to 70° with respect to the axial direction of the pipe. Between the counter-tapered portions of the insulated pipe 18 and the opposed surfaces of the fastening fixtures 19 are disposed shock absorbers 20. The surfaces of the fastening fixtures 19 which abut the shock absorbers 20 are tapered to be parallel to the counter-tapered surfaces of the insulated pipe. The shock absorbers 20 are provided to effectively enlarge the contact surface areas of the fastening fixtures 19 and the insulated pipe 18 thereby to lower the pressure per unit area. The method of connecting the main guide pipe 1, the insulated pipe 18 and the electrode 3 and the method of heating the oil sand layer 6 thereby to ease the extraction of the oil are similar to those of the conventional device.

Figure 4:
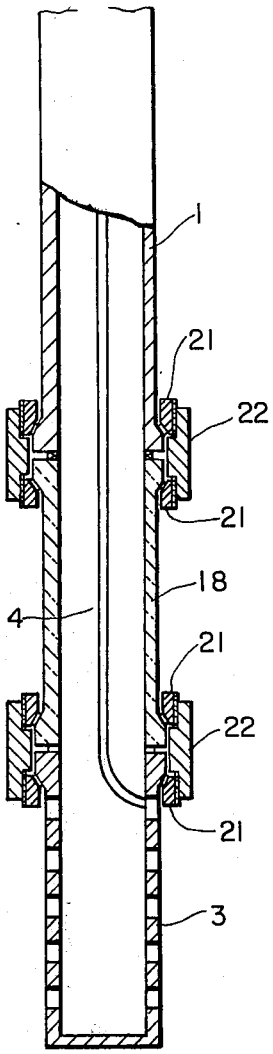
FIG. 4 is a sectional view showing a second embodiment of the present invention.

FIG. 4 shows another embodiment of the invention. According to this embodiment, the end portions of the main guide pipe 1 and the electrode 3 which face the insulated pipe 18 are counter-tapered similarly to the insulated pipe 18. To the respective counter-tapered surfaces, moreover, there are applied fastening fixtures 21, on which connectors 22 are attached with bolts. Upon fastening the connectors 22, the facing respective fastening fixtures 21 approach each other so that the main guide pipe 1 and the insulated pipe 18, and the electrode 3 and the insulated pipe 18 are respectively connected.

According to the present invention, as the insulated pipe is fastened using the fastening fixtures, contracting pressures upon the outer surface of the insulated pipe to the center are applied to the end portions of the insulated pipe thereby damping stress which is generated within the insulated pipe by the pressure of the hot water flowing in the pipe.

Moreover, since the end portions of the insulated pipe are formed with counter-tapered surfaces, there is no concentration of stress due to the gradual change in the thickness of the insulated pipe in a region B indicated in FIG. 3. Furthermore, since the tensile stress in the region B due to the bending moment is reduced to a far smaller level than that of the conventional device, there is no tendency for the pipe to break in that region. As a result, large tensile stresses and concentrations of stress are prevented from occurring in the insulated pipe so that an insulated pipe having a high strength is enonomically provided by the invention. Yet further, it can be appreciated that the electrode structure is unbreakable even if hot water under a high pressure is supplied.

What is claimed is:

1. In an oil well construction in which an insulated pipe of porcelain is interposed between and has one end contacting a main guide pipe and a second end contacting an electrode thereby to insulatingly connect the guide pipe and electrode and in which an electric current is coupled to said electrode, an electrode device for electrically heating underground deposits of hydrocarbons comprising an insulated pipe having a body portion of a first diameter, an end portion of a second diameter greater than said first diameter, and an outer circumferential portion between said body portion and said end portion, said outer circumferential portion being formed with counter-tapered surfaces which diverge at a predetermined angle away from said body portion and toward said end portion; shock absorbers; fastening fixtures disposed in abutting engagement with said counter-tapered surfaces through said shock absorbers; said shock absorbers disposed annularly about said insulating pipe and disposed between the end portion of a second diameter and said fastening fixtures; and means for coupling said fastening fixtures to connectors which are coupled to said main guide pipe and said electrode.

2. The electrode device as set forth in claim 1 wherein said counter-tapered surfaces of said insulated pipe are inclined at an angle of 20 to 70 degrees with respect to the axial direction of said insulated pipe.

3. The electrode device as set forth in claim 1 or 2 wherein said coupling means comprises bolts for coupling said connectors to said fastening fixtures.

4. The electrode device as set forth in claim 1 or 2 wherein an end portion of said main guide pipe adjacent one end of said insulated pipe and an end of said electrode adjacent the other end of said insulated pipe have counter-tapered surfaces similar to said counter-tapered surfaces of said insulated pipe.

* * * * *